US007049557B2

(12) United States Patent
DeAngelis et al.

(10) Patent No.: US 7,049,557 B2
(45) Date of Patent: May 23, 2006

(54) REGULATED FLEXIBLE HEATER

(75) Inventors: Alfred R. DeAngelis, Spartanburg, SC (US); David Bruce Wilson, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/675,061

(22) Filed: Sep. 30, 2003

(65) Prior Publication Data

US 2005/0067404 A1 Mar. 31, 2005

(51) Int. Cl.
*H05B 3/34* (2006.01)

(52) U.S. Cl. ..... 219/545; 219/212; 219/549; 219/517; 219/529; 219/505

(58) Field of Classification Search ..... 219/545, 219/528–529, 208, 515, 212, 217, 494, 505; 338/208

See application file for complete search history.

(56) References Cited

U.S. PATENT DOCUMENTS

| | | | | |
|---|---|---|---|---|
| 4,031,352 | A | 6/1977 | Oosterberg | 219/212 |
| 4,058,704 | A | 11/1977 | Shimizu | 219/528 |
| 4,061,827 | A | 12/1977 | Gould | 428/368 |
| 4,198,562 | A | 4/1980 | Mills et al. | |
| 4,485,296 | A * | 11/1984 | Ueda et al. | 219/505 |
| 4,577,094 | A | 3/1986 | Mills | 219/605 |
| 4,598,195 | A * | 7/1986 | Matsuo | 219/497 |
| 4,607,154 | A | 8/1986 | Mills | 219/605 |
| 4,633,062 | A | 12/1986 | Nishida et al. | 219/212 |
| 4,656,334 | A * | 4/1987 | Endo et al. | 219/212 |
| 4,677,281 | A | 6/1987 | Mills | 219/505 |
| 4,855,572 | A * | 8/1989 | Wallgren et al. | 219/444.1 |
| 5,422,482 | A | 6/1995 | Nakajima et al. | 219/645 |
| 5,484,983 | A | 1/1996 | Roell | 219/545 |
| 5,581,192 | A | 12/1996 | Shea et al. | 324/722 |
| 5,776,609 | A | 7/1998 | McCullough | 428/375 |
| 5,804,291 | A | 9/1998 | Fraser, Jr. | 428/283 |
| 5,824,996 | A | 10/1998 | Kochman et al. | 219/529 |
| 5,837,164 | A | 11/1998 | Zhao | 252/500 |
| 5,861,610 | A | 1/1999 | Weiss | 219/497 |
| 5,902,518 | A | 5/1999 | Khazai et al. | 252/511 |
| 5,916,506 | A | 6/1999 | Breznak et al. | 264/104 |
| 5,952,099 | A | 9/1999 | Asher et al. | 428/370 |
| 5,968,854 | A | 10/1999 | Akopian et al. | 442/132 |
| 5,972,499 | A | 10/1999 | Rodriguez et al. | 428/368 |
| 6,080,690 | A | 1/2000 | Lebby et al. | 442/209 |
| 6,090,313 | A | 7/2000 | Zhao | 252/500 |
| 6,093,908 | A | 7/2000 | Haag | 219/204 |
| 6,160,246 | A | 12/2000 | Rock et al. | 219/545 |
| 6,172,344 | B1 | 1/2001 | Gordon et al. | 219/529 |
| 6,174,825 | B1 | 1/2001 | Dutt | 442/43 |
| 6,215,111 | B1 | 4/2001 | Rock et al. | 219/545 |
| 6,229,123 | B1 | 5/2001 | Kochman et al. | 219/549 |
| 6,242,094 | B1 | 6/2001 | Breznak et al. | 428/373 |
| 6,288,372 | B1 | 9/2001 | Sandberg et al. | 219/644 |
| 6,310,332 | B1 * | 10/2001 | Gerrard | 219/505 |
| 6,381,482 | B1 | 4/2002 | Jayaraman et al. | |
| 6,497,951 | B1 | 12/2002 | DeAngelis et al. | |

(Continued)

*Primary Examiner*—Robin O. Evans
*Assistant Examiner*—Vinod Patel
(74) *Attorney, Agent, or Firm*—Terry T. Moyer; Cheryl J. Brickey; Jeffery E. Bacon

(57) ABSTRACT

A flexible body has a conductive resistance pathway which includes conductive resistance flexible strands of material connected in series between two supply bus flexible strands of material, and a temperature dependent variable resistance pathway with temperature dependent variable resistance flexible strands of material electrically connected in series by connection bus flexible strands of material.

40 Claims, 8 Drawing Sheets

U.S. PATENT DOCUMENTS

| | | | | |
|---|---|---|---|---|
| 6,680,117 | B1 | 1/2004 | DeAngelis et al. | 428/372 |
| 6,713,733 | B1 * | 3/2004 | Kochman et al. | 219/549 |
| 6,756,572 | B1 * | 6/2004 | Lee | 219/505 |
| 6,768,086 | B1 * | 7/2004 | Sullivan et al. | 219/494 |
| 6,770,854 | B1 | 8/2004 | Keane | 219/529 |
| 2001/0025846 | A1 | 10/2001 | Kochman et al. | 219/545 |
| 2002/0137831 | A1 | 9/2002 | Horibe et al. | 524/439 |
| 2003/0015285 | A1 | 1/2003 | Iwamoto et al. | 156/325 |

* cited by examiner

FIG. –1–

REGULATED FLEXIBLE HEATER

BACKGROUND

The present invention generally relates to flexible heaters, and in particular, flexible heaters with temperature feedback control.

DETAILED DESCRIPTION

Figure 1:
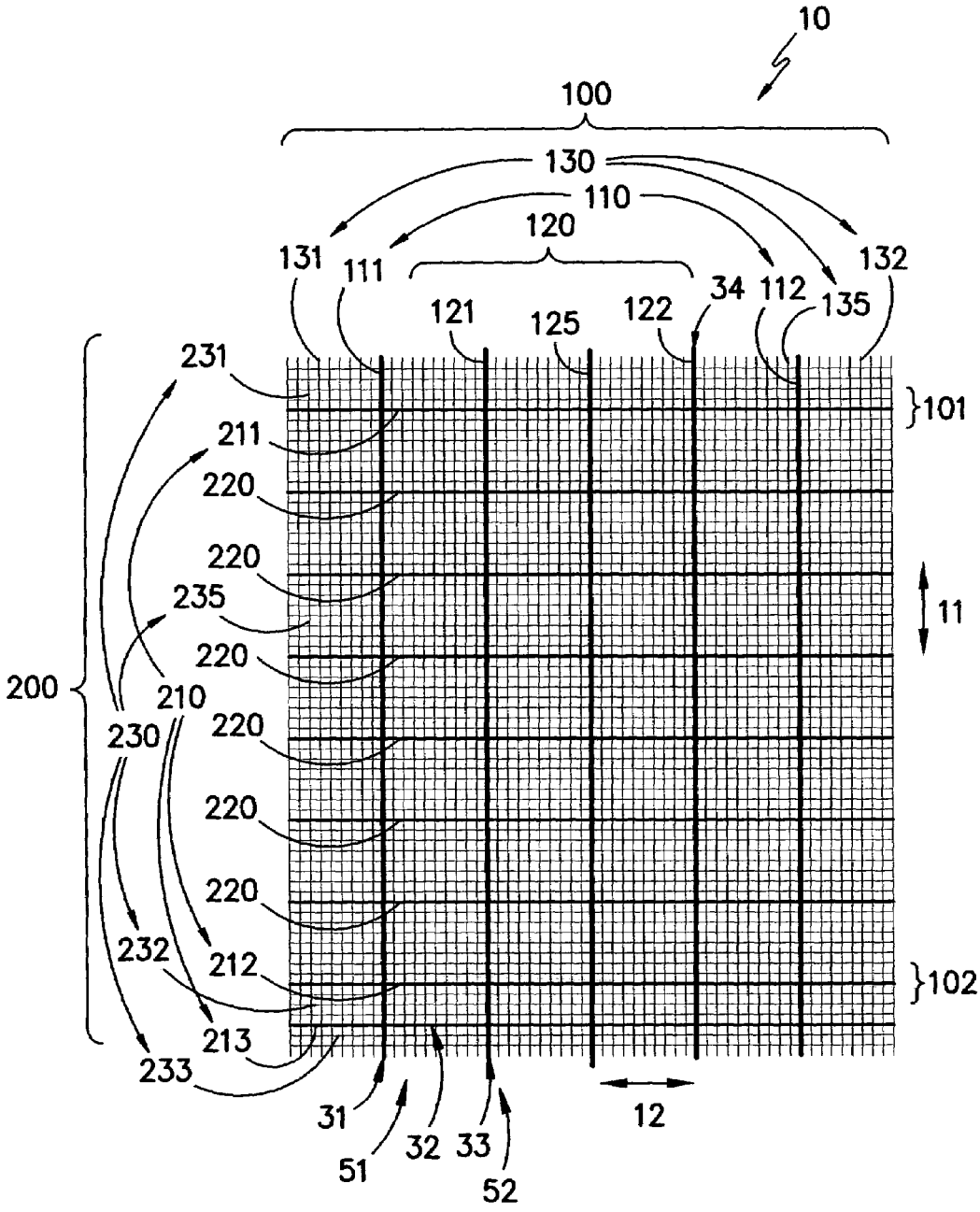
FIG. 1 is an illustration of a first embodiment of a flexible heater according to the present invention.

Referring now to the Figures, and in particular to FIG. 1, there is shown a flexible heater 10 having a first direction 11 and a second direction 12. The flexible heater 10 generally includes a first set of flexible strands of material 100 and a second set of flexible strands of material 200. As used herein, strands of material, or strand, shall mean a single independent unit of a continuous slender elongated body having a high ratio of length to cross-sectional distance, such as cords, wires, tapes, threads, yarns, or the like. A strand of material, or strand, can be a single component, or multiple components combined to form the continuous strand. Flexible, as used herein in association with a strand of material, or strand, shall mean the ability to bend around an axis perpendicular to the lengthwise direction of the strand with light to moderate force. In one embodiment, the flexible strand of material requires no more than about 500 grams of force to be pressed through a 5/16 inch wide slot to a depth ¼ inch, such as performed by a Handle-O-Meter manufactured by Albert Instrument Co., Philadelphia, Pa.

Referring still to FIG. 1, the first set of flexible strands of material 100 are disposed longitudinally in the first direction 11 of the flexible heater 10, and have a first end zone 101 and a second end zone 102. The second end zone 102 is separated from the first end zone 101 in the first direction 11. The first set of flexible strands of material 100 generally include flexible supply bus strands of material 110 and flexible temperature dependent variable resistance strands of material 120. As used herein, the terms bus strand of material or strand shall mean a strand of conductive material. In one example, a bus strand has a resistance of about 0.01 ohms/inch or less.

As used herein, the terms temperature dependent variable resistance (sometimes shortened to "TDVR") strand of material or strand shall mean a strand of material in which the resistance varies with a change in the temperature of the material. A TDVR strand can have a positive temperature coefficient of temperature to resistance (sometimes shortened to "PTC") or a negative temperature coefficient of temperature to resistance (sometimes shortened to "NTC"). An PTC TDVR strand is a strand of material in which the resistance of the strand increases as the temperature of the strand increases, and the resistance of the strand decreases as the temperature of the strand decreases. An example of a PTC TDVR strand would be a flexible strand of material formed from nickel, or some other material with a PTC characteristic. An NTC TDVR strand is a strand of material in which the resistance of the strand decreases as the temperature of the strand increases, and the resistance of the strand increases as the temperature of the strand decreases. An example of a NTC TDVR strand would be a flexible strand of material formed from conductive polymers with a negative temperature coefficient like polyaniline, polypyrrole, polythiophene, or some other material with a NTC characteristic.

Still referring to FIG. 1, the supply bus strands 110 include a first supply bus flexible strand of material or first supply bus strand 111 and a second supply bus flexible strand of material or second supply bus strand 112. Also, the temperature dependent variable resistance strands 120 include a first edge temperature dependent variable resistance flexible strand of material or first edge TDVR strand 121, a second edge temperature dependant variable resistance flexible strand of material or second TDVR strand 122, and a center temperature dependent variable resistance flexible strand of material or center TDVR strand 125. Although, FIG. 1 illustrates the flexible heater 10 having only one center TDVR strand 125, as will be shown below, the present invention contemplates that the flexible heater 10 can have multiple center TDVR strands 125. As illustrated, the first edge TDVR strand 121 is disposed between the first supply bus strand 111 and the second supply bus strand 112. Also as illustrated, the second edge TDVR strand 122 is disposed between the first edge TDVR strand 121 and the second supply bus strand 112. The center TDVR strand 125 is disposed between the first edge TDVR strand 121 and the second edge TDVR strand 122.

Referring still to FIG. 1, the first set of flexible strands of material 100 in the flexible heater 10 can also include a plurality of flexible first set non-conductive strands of material or strands 130. As used herein, the terms non-conductive strand of material or strand shall mean a strand of material of such low conductivity that any flow of electric current through it is negligible. In one example, a non-conductive strand of material will have a resistivity of at least $1\times10^{13}$ ohms/inch.

Still referring to FIG. 1, the first set of non-conductive strands 130 include first edge non-conductive flexible strands of material or first edge non-conductive strands 131, second edge non-conductive flexible strand of material or second edge non-conductive strands 132, and first set center non-conductive flexible strands of material or first set center non-conductive strands 135. The first edge non-conductive strands 131 are disposed outside of between the first supply bus strand 111 and the second supply bus strand 112, and are closer to the first supply bus strand 111 than the second supply bus strand 112. The second edge non-conductive strand 132 is disposed outside of between the first supply bus strand 111 and the second supply bus strand 112, and are closer to the second supply bus strand 112 than the first supply bus strand 111. The first set center non-conductive strands 135 are disposed between the first supply bus strand 111 and the second supply bus strand 112. Typically, the TVDR strands 120 are disposed amongst the first set center non-conductive strands 135.

Referring still to FIG. 1, the second set of flexible strands of material 200 are disposed longitudinally along the second direction 12 of the flexible heater 10. The second set of flexible strands of material 200 generally include flexible connection bus strands of material or strands 210 and a plurality of flexible conductive resistance strands of material or strands 220. As used herein, the terms conductive resistance strand of material or strand shall mean a strand of conductive material with a resistivity selected to generate the desired heat from the available voltage. In one embodiment, the conductive resistance strand of material has a conductivity no greater than the any strand supplying electrical power to the conductive resistance strand of material.

Still referring to FIG. 1, the connection bus strands 210 include a first connection bus flexible strand of material or first connection bus strand 211, a second connection bus flexible strand of material or second connection bus strand 212, and a third connection bus flexible strand of material or third connection bus strand 213. The first connection bus strand 211 is disposed in the first end zone 101 of the first set of flexible strands of material 100. The second connection bus flexible strand of material 212 is disposed in the second end zone 102 of the first set of flexible strands of material 100. The third connection bus strand 213 is located outside between the first connection bus strand 211 and the second connection bus strand 212, and is closer to the second connection bus strand 212 than the first connection bus strand 211. Also as illustrated in FIG. 1, the plurality of conductive resistance strands 220 are disposed between the first connection bus strand 211 and the second connection bus strand 212.

Referring still to FIG. 1, the second set of flexible strands of material 200 can also include a flexible second set of non-conductive strands of material or strands 230. The second set of non-conductive strands 230 include first end non-conductive flexible strands of material or first end non-conductive strands 231, second end non-conductive flexible strands of material or second end non-conductive strands 232, third end non-conductive flexible strands of material or third end non-conductive strands 233, and second set center non-conductive flexible strands of material or second set center non-conductive strands 235. The first end non-conductive strands 231 are disposed outside of between the first connection bus strand 211 and the second connection bus strand 212, and are closer to the first connection bus strand 211 than the second connection bus strand 212. The second end non-conductive strands 232 are disposed between the second connection bus strand 212 and the third connection bus strand 213. The third end non-conductive strands 233 are disposed outside of between the first connection bus strand 211 and the third connection bus strand 213, and are closer to the third connection bus strand 213 than the first connection bus strand 211. The second set center non-conductive strand 235 are disposed between the first connection bus strand 211 and the second connection bus strand 212. Typically, the conductive resistance strands 220 are disposed amongst the second set center non-conductive strands 235.

Still referring to FIG. 1, the first set of flexible strands of material 100 and the second set of flexible strands of material 200 are combined into a flexible planar body of the flexible heater 10. The first set of flexible strands of material 100 and the second set of flexible strands of material 200 can be combined to form the flexible planar body of the flexible heater 10 by interlacing, bonding, laminating, or other methods. The first set of flexible strands of material 100 and the second set of flexible strands of material 200 can be interlaced into a flexible planar body by weaving, knitting, or the like.

Referring still to FIG. 1, the flexible heater 10 has a conductive resistance pathway 51 which is represented by the first supply bus strand 111, the plurality of conductive resistance strands 220, the second supply bus strand 112, and the third connection bus strand 213. The conductive resistance strands 220 are each electrically connected to the first supply bus strand 111 and the second supply bus strand 112. The third connection bus strand 213 is electrically connected to the second supply bus strand 112. To ensure that the third connection bus strand does not electrically connect the first supply bus strand 111 with the second supply bus strand 112, the third connection bus strand can be cut or severed near the first supply bus strand 111 to prevent electrical continuity. Outside connections can be made to the conductive pathway 51 by a conductive resistance power supply connection 31 with the first supply bus strand 111, and a conductive resistance ground connection 32 with the third connection bus strand 213.

Still referring to FIG. 1, the flexible heater 10 also has a temperature depended variable resistance pathway 52 which is represented by the TDVR strands 120 and the first and second connection bus strands 211 and 212. As illustrated, the first connection bus strand 211 electrically connects the first edge TDVR strand 121 in the first zone 101 with the center TDVR strand 125 in the first zone 101, and electrically connects the second edge TDVR strand 122 in the first zone 101 with the second supply bus strand 112 in the first zone 101. To ensure that the first connection bus strand 211 does not electrically connect the first supply bus strand 111 with the first edge TDVR strand 121 or the center TDVR strand 125 with the second edge TDVR strand 122, the first connection bus strand 211 can be cut or severed between first supply bus strand 111 and the first edge TDVR strand 121, and can be cut or severed between the center TDVR strand 125 and the second edge TDVR strand 122, thereby creating electrically separate segments of the first connection bus strand 211. Also as illustrated, the second connection bus strand 212 electrically connects the center temperature dependent variable resistance strand 125 in the second zone 102 with the second edge temperature dependent variable resistance strand 122 in the second zone 102. To ensure that the second connection bus strand 212 does not electrically connect the first supply bus strand 111 with the first edge TDVR strand 121, or the first edge TDVR strand 121 with the closest center TDVR strand 125, or the second edge TDVR strand 122 with the second supply bus strand 112, the second connection bus strand 212 can be cut or severed between the first supply bus strand 111 and the first edge TDVR strand 121, the first edge TDVR strand 121 and the closest center TDVR strand 125, and the second edge TDVR strand 122 and the second supply bus strand 112. Outside connections can be made to the TDVR pathway 52 by a temperature dependent variable resistance power connection 33 with the first edge TDVR strand 121 in the first zone 101, and a temperature dependent variable resistance ground connection 34 with the second TDVR strand 122 in the second zone 102.

Referring still to FIG. 1, the conductive resistance pathway 51 and the TDVR pathway 52 distinct and separate routes that are electrically isolated from each other. As used herein, distinct and separate routes means routes that do not coincide, such as might occur if the components of both the conductive resistance pathway and the temperature dependent resistance pathway were combined into a composite strand and were routed through the flexible heater 10 as a signal unit. The separation of the conductive resistance pathway 51 and the TDVR pathway 52 provide a great advantage to the flexible heater 10: The changing of the resistance in the TDVR pathway 52 will be due to the change in temperature in the area of the flexible heater 10 in which the TDVR pathway 52 runs and will not be dominated by the actual temperature of the components in the conductive resistance pathway 51. In the embodiment in FIG. 1, the TDVR strands 120 are disposed in a direction substantially perpendicular to the conductive resistance strands 220.

Figure 2:
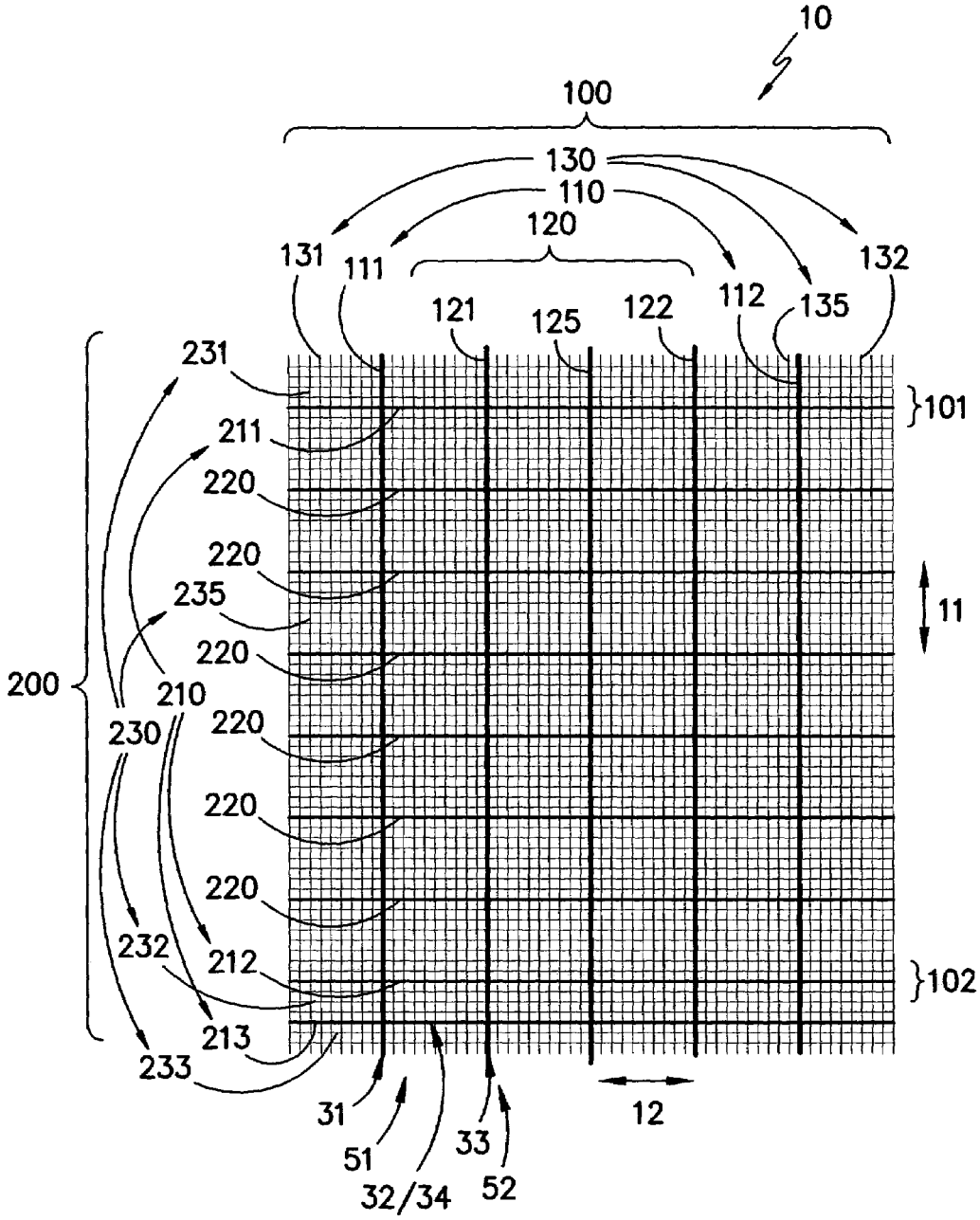
FIG. 2 is an illustration of the flexible heater in FIG. 1, having alternate electrical connections of the first connection bus strand and the second connection bus strand.

Referring now to FIG. 2, there is shown the flexible heater 10 from FIG. 1, illustrating alternate connections of the first connection bus strand 211 and the second connection bus strand 212. As illustrated, the first connection bus strand 211 electrically connects the first edge TDVR strand 121 in the first zone 101 with the center TDVR strand 125 in the first zone 101, and electrically connects the second edge TDVR strand 122 in the first zone 101 with the second supply bus strand 112 in the first zone 101.

As illustrated in FIG. 2, the conductive resistance pathway 51 is represented by the first supply bus strand 111, the plurality of conductive resistance strands 220, the second supply bus strand 112, and the third connection bus strand 213, and the temperature dependent variable resistance pathway 52 is represented by the TDVR strands 120, the first and second connection bus strands 211 and 212, the second supply bus strand 112, and the third connection bus strand 213. Outside connections can be made to the conductive resistance pathway 51 by a conductive resistance power supply connection 31 with the first supply bus strand 111, and a conductive resistance ground connection 32 with the third connection bus strand 213. Outside connections can be made to the temperature dependent variable resistance pathway 52 by a temperature dependent variable resistance power connection 33 with the first edge TDVR strand 121, and a temperature dependent variable resistance ground connection 34 with the third connection bus strand 213.

Figure 3:
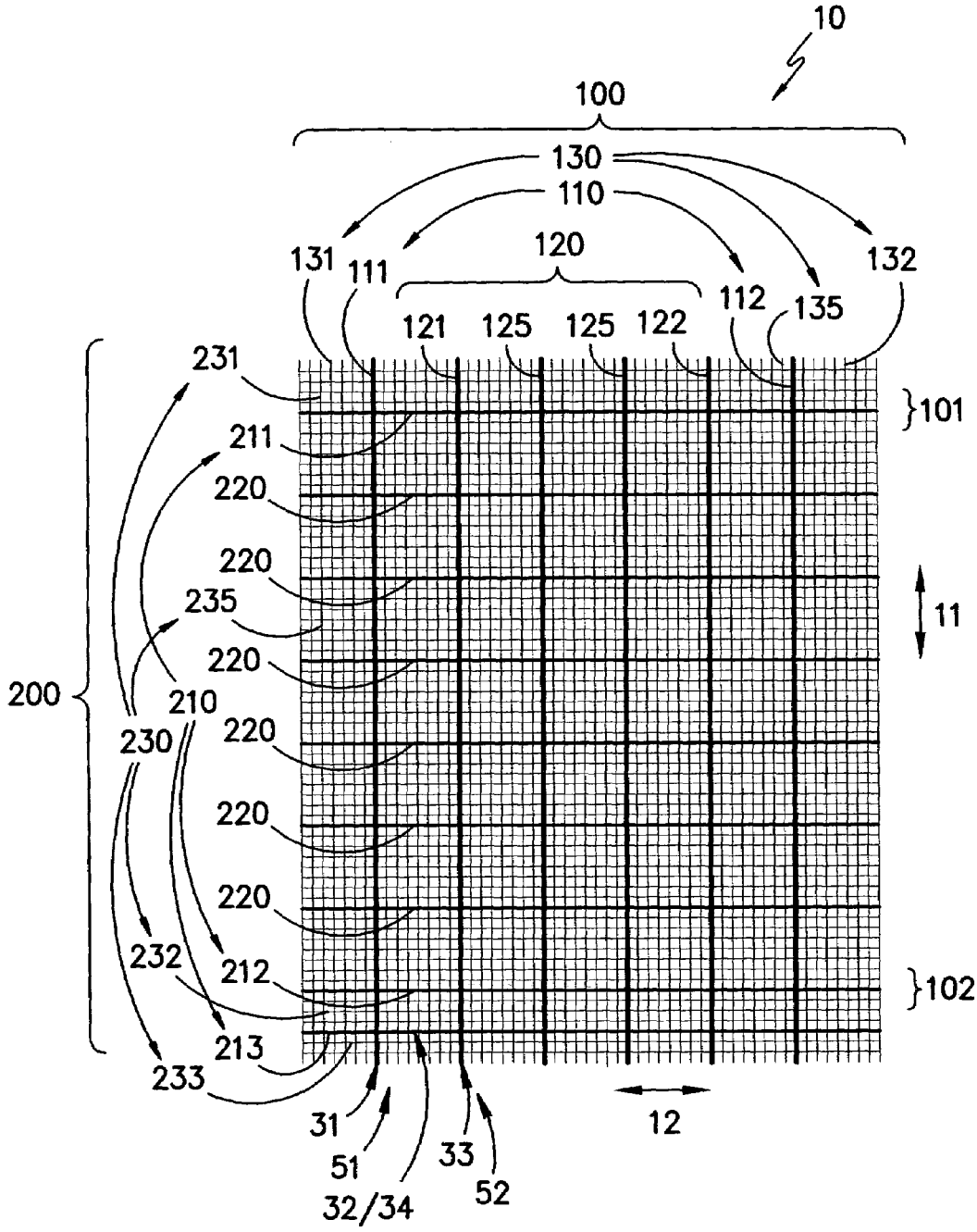
FIG. 3 is an illustration of an alternate embodiment of a flexible heater according to the present invention.

Referring now to FIG. 3, there is shown an alternate embodiment of the flexible heater 10 from FIG. 1, where the TDVR strands 120 of the first set of strands of material 100 include two center TDVR strands 125. In order to accommodate the multiple center TDVR strands 125, the first connection bus strand 211 and the second connection bus strand 212 provide different electrical connections to the TDVR strands 120. As illustrated in FIG. 3, the first connection bus strand 211 electrically connects the first edge TDVR strand 121 with one of the center TDVR strands 125 in the first zone 101, and the other center TDVR strand 125 with the second edge TDVR strand 122 in the first zone 101. To ensure that the first connection bus strand 211 does not electrically connect the first supply bus strand 111 with the first edge TDVR strand 121, or the two center TDVR strands 125 together, or the second edge TDVR 122 with the second supply bus strand 112, the first connection bus strand 211 can be cut or severed between the first supply bus strand 111 and the first edge TDVR strand 121, between the two center TDVR strands 125, and between the second edge TDVR strand 122 and the second supply bus strand 112, thereby creating electrically separate segments of the first connection bus strand 211. The second connection bus strand 212 electrically connects the two center TDVR strands 125 together in the second zone 102, and electrically connects the second edge TDVR strand 122 with the second supply bus strand 112 in the second zone 102. To ensure that the second connection bus strand 212 does not electrically connect the first supply bus strand 111 with the first edge TDVR 121, or the first edge TDVR stand 121 with the center TDVR strands 125, or the center TDVR strands 125 with the second edge TDVR strand 122, the second connection bus strand 212 can be cut or severed between the first supply bus strand 111 and the first edge TDVR strand 121, between the first edge TDVR strand 121 and the center TDVR strands 125, and between the center TDVR strands 125 and the second edge TDVR strand 122, thereby creating electrically separate segments of the second connection bus strand 212.

As illustrated in FIG. 3, the conductive pathway 51 is represented by the first supply bus strand 111, the plurality of conductive resistance strands 220, the second supply bus strand 112, and the third connection bus strand 213, and the TDVR pathway 52 is represented by the TDVR strands 120, the first and second connection bus strands 211 and 212, the second supply bus strand 112, and the third connection bus strand 213. Outside connections can be made to the conductive resistance pathway 51 by a conductive resistance power supply connection 31 with the first supply bus strand 111, and a conductive resistance ground connection 32 with the third connection bus strand 213. Outside connections can be made to the TDVR pathway 52 by a TDVR power connection 33 with the first edge TDVR strand 121, and a TDVR ground connection 34 with the third connection bus strand 213.

Figure 4:
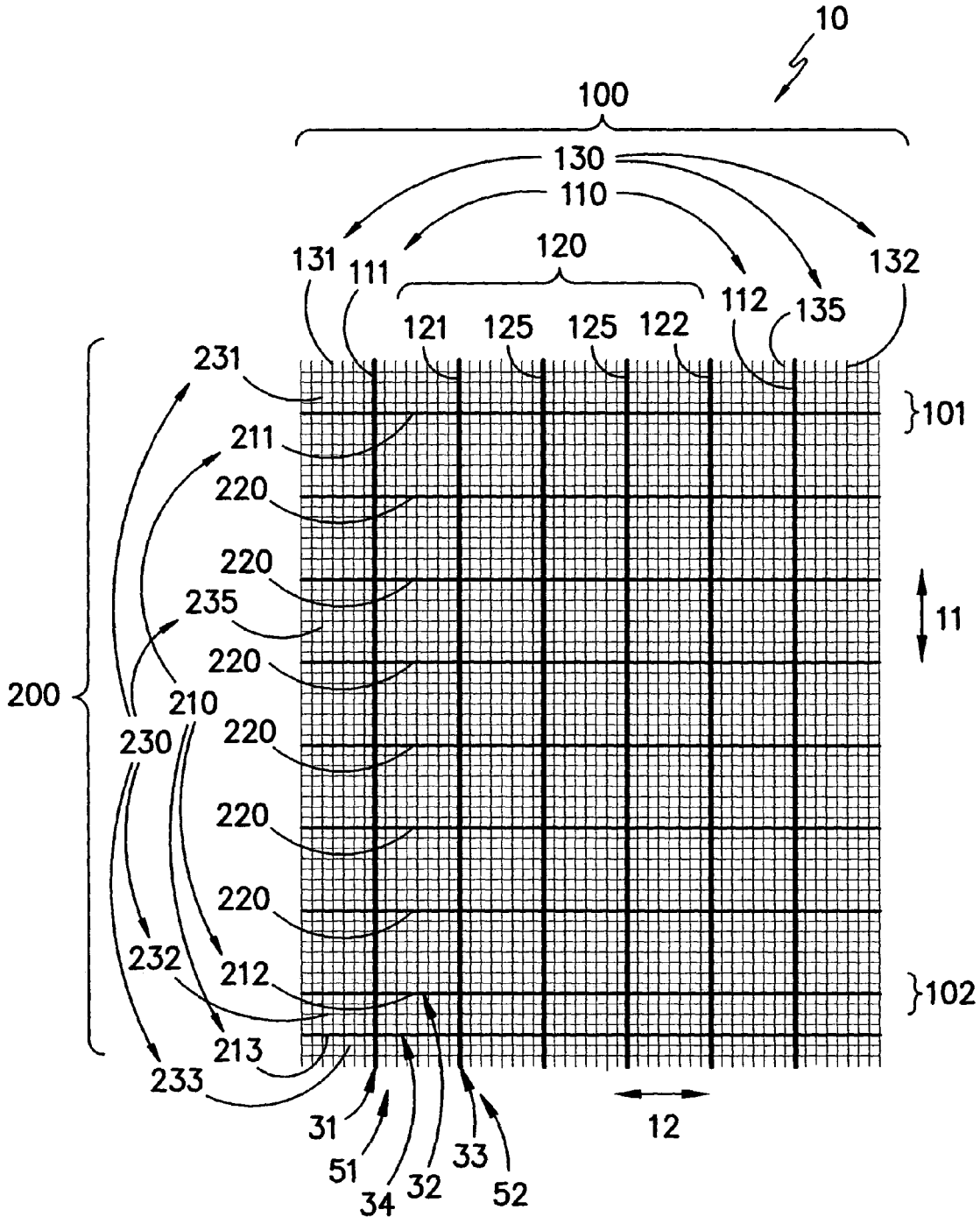
FIG. 4 is an illustration of the flexible heater in FIG. 3, incorporating a fourth connection bus.

Referring now to FIG. 4, there is shown an alternate embodiment of the flexible heater 10 in FIG. 3, incorporating a fourth connection bus flexible strand of material 214 in the connection bus strands 210 of the second set of flexible strands of material 200. As illustrated in FIG. 4, the fourth connection bus strand 214 is located outside of between the first connection bus strand 211 and the third connection bus strand 213 with the fourth connection bus strand 214 being closer to the third connection bus strand 213 than the first connection bus strand 211. The second connection supply bus 212 does not make an electrical connection between the second end TDVR strand 122 and the second supply bus strand 112. Also, the fourth connection bus strand 214 electrically connects with the second edge TDVR strand 122, but does not electrically connect with the second supply bus strand 112. Outside connection of the TDVR pathway 52 is made by a TDVR power connection 33 with the first edge TDVR strand 121, and a TDVR ground connection 34 with the fourth connection bus strand 214.

As illustrated in FIG. 4, the conductive pathway 51 is represented by the first supply bus strand 111, the plurality of conductive resistance strands 220, the second supply bus strand 112, and the third connection bus strand 213, and the TDVR pathway 52 is represented by the TDVR strands 120, the first and second connection bus strands 211 and 212, and the fourth connection bus strand 214. Outside connections can be made to the conductive pathway 51 by the conductive resistance power supply connection 31 with the first supply bus strand 111, and the conductive resistance ground connection 32 with the third connection bus strand 213. Outside connections can be made to the TDVR pathway 52 by the TDVR power connection 33 with the first edge TDVR strand 121, and the TDVR ground connection 34 with the fourth connection bus strand 214.

As described with reference to FIGS. 1–4, when it is desired to ensure that a particular connection bus strand 210 does not make an electrical connection between TDVR strands 120 and/or supply bus strands 110, the connection bus strand 210 can be cut or severed between the two strands to remain electrically isolated, thereby creating separate segments of the connection bus strand 210 and preventing electrical connection between the two TDVR strands 120. The cut or severing of the connection bus strand 210 can be accomplished by cutting only the particular connection bus strand 210, or by cutting a hole in the flexible heater 10 in the location of the connection bus strand 210 which is to be severed.

FIGS. 1 and 2 illustrate when an odd number of TDVR strands 120 are used in the TDVR pathway 52, and FIGS. 3 and 4 illustrate when an even number of TDVR strands 120 are used in the TDVR pathway 52. The number of TDVR strands 120 in the temperature dependent variable resistance pathway 52 can be increased or decreased by increasing or decreasing the number of TDVR strands 125 which are connected in series between the TDVR power supply connection 33 and the TDVR ground connection 34. In another embodiment, the TDVR pathway 52 can be formed by a single TDVR strand of material 120 that runs between the TDVR power supply connection 33 and the TDVR ground connection 34. In the embodiment with a single TDVR strand of material 120, bus strands of material can be used to make electrical connections with the TDVR strand of material 120.

Figure 5:
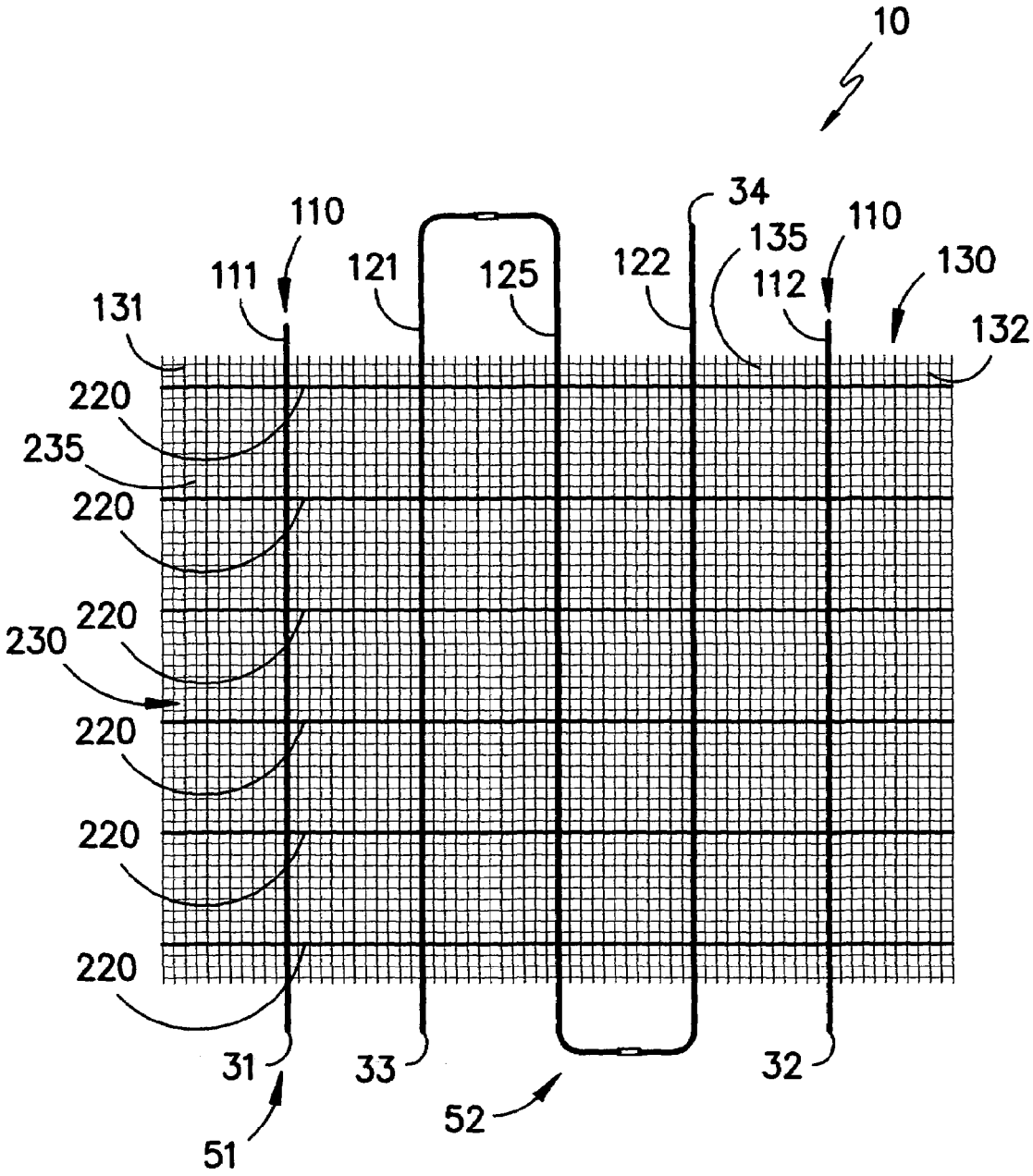
FIG. 5 is an illustration of the present invention with electrical connections being made without a connection bus.

As illustrated in FIGS. 1–4, the TDVR strands 120 are connected by bus strands of material, or segments of bus strands of material. However, it is also contemplated by the present invention that the TDVR strands 120 can be connected directly without bus strands of material or segments of bus strands of material. In an embodiment where the TDVR strands 120 are connected directly, as illustrated in FIG. 5, the TDVR strands 120 extend beyond the surrounding first set of flexible strands 100 and second set of flexible strands 200. The portion of the each of the TDVR strands 120 that extend beyond the surrounding first set of flexible strands 100 and second set of flexible strands 200, are connected to other components extending beyond the surrounding first set of flexible strands 100 and second set of flexible strands 200, such as a supply bus strand 110 or another TDVR strand 120. Additionally, the first supply bus strand 111 and the second supply bus strand 112 can extend beyond the surrounding first set of flexible strands 100 and the second set of flexible strands 200 to facilitate direct connections with the supply bus strands 111 and 112.

In a particularly preferred embodiment of the invention in FIGS. 1–5, the first set of flexible strands of material 100 and the second set of flexible strands of material 200 are yarns, are woven together to form the flexible heater 10 as woven fabric. As used herein yarn shall mean a continuous strand of textile fibers, textile filaments, or material in a form suitable for knitting, weaving, or otherwise intertwining to form a textile. The term yarn includes, but is not limited to, yarns of monofilament fiber, multifilament fiber, staple fibers, or a combination thereof. The supply and connection bus strands 110 and 210 of a woven flexible heater 10 can be a copper yarn, brass yarn, other solid metal yarns, fine-gauge wire, or the like. The temperature dependent variable resistance strands 120 of the flexible heater 10 can have a positive temperature coefficient, such as the yarns disclosed in U.S. Pat. No. 6,497,951, titled "Temperature Dependent Electrically Resistive Yarn" and issued on Dec. 24, 2002, to DeAngelis et al., a high temperature-coefficient metal (such as nickel) wire or yarn, or the like. In another embodiment, the temperature dependent variable resistance strands 120 of the flexible heater 10 can have a negative temperature coefficient, such as a yarn formed from conductive polymers with a negative temperature coefficient like polyaniline, polypyrrole, polythiophene, or the like. The conductive resistance yarns 220 of the woven flexible heater 10 can be silver coated nylon yarns, other yarns that are silver coated, stainless steel yarns, other yarns of low-conductivity metals, spun yarns with a conductive-fiber component, or the like. The first set of non-conductive yarns 130 and the second set of non-conductive yarns 230 of a woven flexible heater 10 can be multifilament polyester yarn.

Still referring to FIGS. 1–5, in a method of forming the flexible heater 10 as a woven material, the first set of yarns 100 and the second set of yarns 200 are interlaced in a weave pattern to create the initial fabric. After the initial fabric is woven, the connection bus strands 210 can be electrically connected to the temperature dependent variable resistance strands 120 by physical contact such as contact due to mechanical force, an additional conductive thread sewn between and/or through each of the strands, or the like. Also, the conductive resistance strands 220 can be connected to the supply bus strands 110 by contact due to mechanical force, such as generated by a weave pattern of the strands, or by an electrically conductive paste or adhesive between the strands. Additionally, the third connection bus strand 213 can be electrically connected to the second supply bus strand 112 by physical contact such as contact due to mechanical force, and/or by an electrically conductive paste or adhesive between the strands, and/or by a splice such as butt splice in two ends of the strands separated from the other strands, and/or a conductive thread sewn between and through the strands. In areas where it is desired to cut or sever the connection bus strands, a hole can be cut or made in the fabric 10 at the desired location of the severing, thereby separating the connection bus strand into electrically separate segments.

Figure 6:
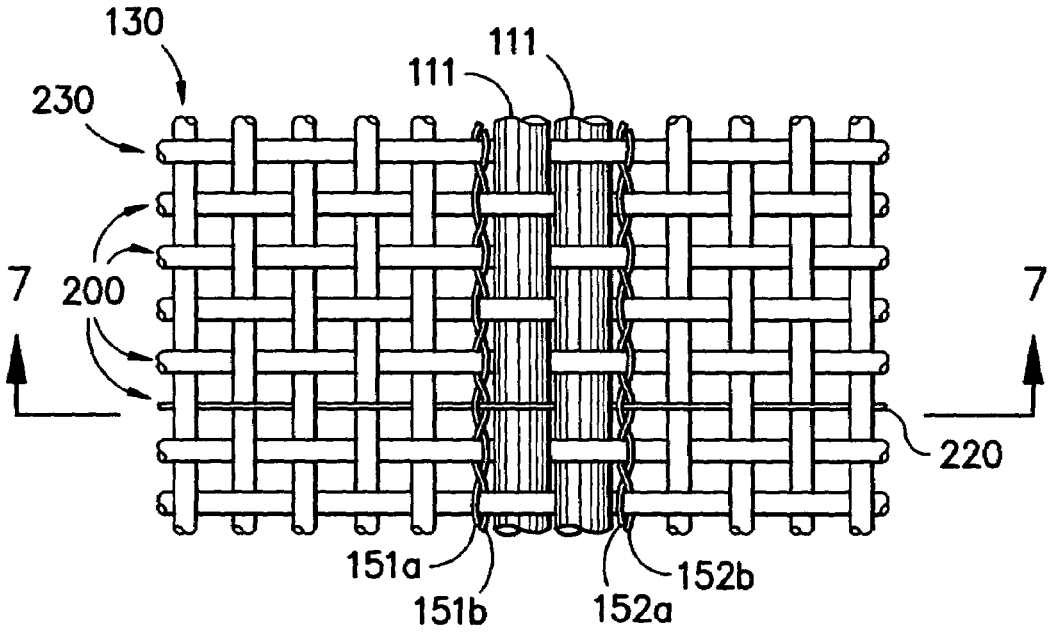
FIG. 6 is a partial enlarged plan view of one embodiment of the present invention, illustrating the use of a weave pattern to facilitate electrical connection through mechanical contact.

Referring now to FIG. 6, there is shown a partial enlarged plan view of an embodiment of the present invention, illustrating the use of a weave pattern for making electrical connections due to mechanical force. As shown in FIG. 6, the first supply bus strand 111 and the first set of non-conductive flexible strands 130 are woven with the conductive resistance flexible strand 220 and the second set non-conductive strands of flexible material 230. As illustrated in FIG. 6, the first supply bus strand 111 is actually a pair of conductive yarns interlaced with the conductive resistance strand 220 and the second set of non-conductive strands 230. However, the present invention also contemplates that a supply bus strand can be a single conductive yarn or more than two conductive yarns. As illustrated in FIG. 6, two pairs of leno yarns 151*a/b* and 152*a/b* are disposed along the first supply bus strand 111 and adjacent to either side of the first supply bus strand 111. In one embodiment, the leno yarns 151*a/b* and 152*a/b* have a smaller denier than the first supply bus yarn 111. The leno yarns 151*a* and 151*b* interlace with the conductive resistance strand 220 and the non-conductive strands 230, and also twist over each other between yarns from the second set of yarns 200 to form the leno weave. The leno yarns 152*a* and 152*b* also interlace with the conductive resistance strand 220 and the non-conductive strands 230, and also twist over each other between yarns from the second set of yarns 200 to form the leno weave. The leno yarns 151*a/b* and 152*a/b* can twist over each other between each yarn of the second yarn set 200, or can skip individual yarns from the second yarn set 200 before twisting over each other. In one preferred embodiment, the leno yarns 151*a/b* and/or 152*a/b* pass through the same dent in a loom forming the flexible heater 10 as the first bus strand 111.

Figure 7:
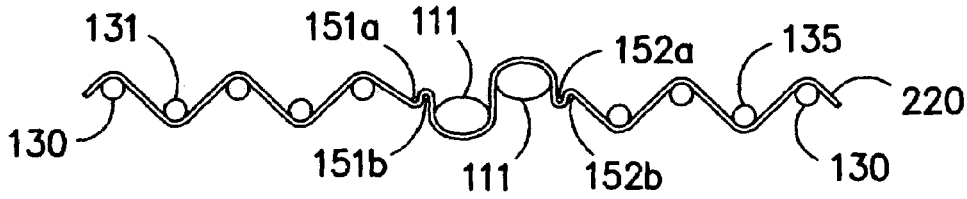
FIG. 7 is an enlarge cross sectional view of the portion of invention as illustrated in FIG. 6, taken about the section lines 7—7.

Referring now to FIG. 7, there is shown an enlarged cross section of the embodiment of the invention taken about the section lines 7—7. The leno yarns 151*a/b* and 152*a/b* force the pair of conductive yarns together that form the first supply bus strand 111, thereby facilitating an electrical connection with the conductive resistance strand 220 passing between the conductive yarns of the first supply bus strand 111. Also as shown in FIG. 7, the leno yarns 151*a/b* and 152*a/b* also cause the conductive resistance yarn 220 to pass over more surface area of the first supply bus strand 111, thereby creating a better electrical connection. The use of leno weave yarns can also be done in association with the second supply bus strand 112 to facilitate connections therewith. In one embodiment, the leno yarns 151*a/b* and/or 152*a/b* are a conductive yarn, such as a silver coated nylon yarn. It has been found that by using conductive yarns for the leno yarns 151*a/b* and/or 152*a/b*, the reliability and durability of the electrical connection with the supply bus strand is improved. In a version where the leno yarns 151*a/b* and/or 152*a/b* are a conductive yarn, is preferred that the leno yarns 151*a/b* and/or 152*a/b* electrically connect with the first supply bus strand 111.

Referring now to FIGS. 6 and 7, in one embodiment the leno yarns 151*a/b* and 152*a/b* have a low-melt component yarn to lock the strands in place. In one example of this embodiment, the leno yarns 151*a/b* and 152*a/b* have a core/sheath configuration where the sheath has a melt temperature below the melt temperature of the core. After the flexible heater 10 is formed, the leno yarns 151*a/b* and 152*a/b* are subjected to heat and/or pressure to cause the low-melt component of the leno yarns 151*a/b* and 152*a/b* to melt. Once the leno yarns 151*a/b* and 152*a/b* re-solidify, the leno yarns 151*a/b* and 152*a/b* lock the surrounding strands into place enhancing the mechanical stability of the structure.

Figure 8:
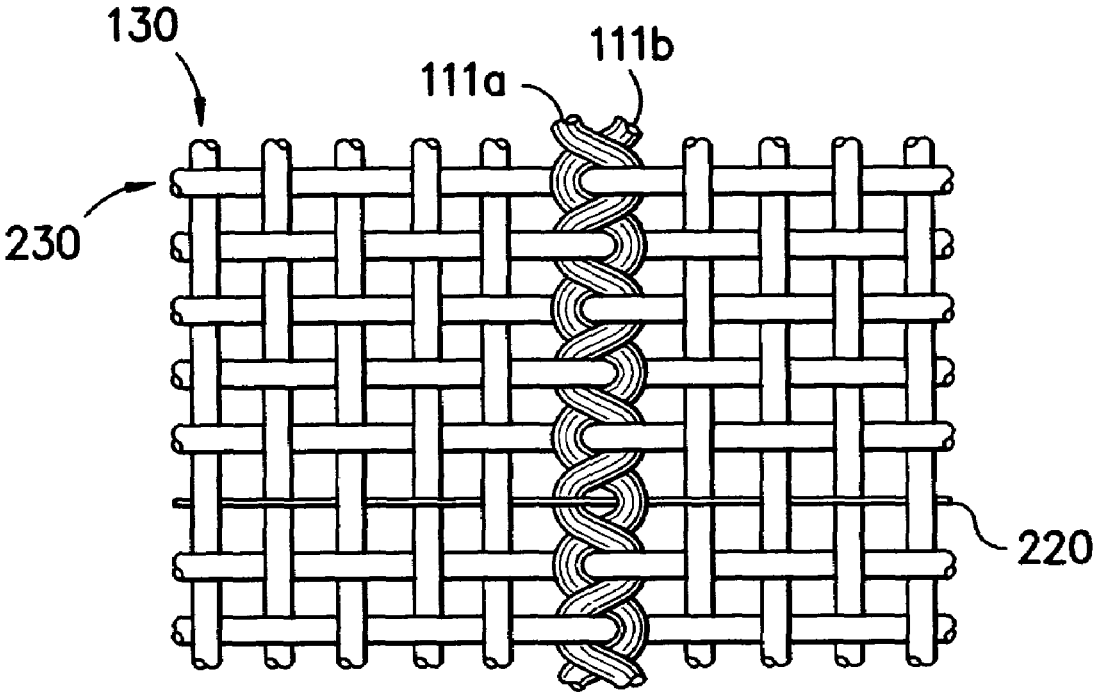
FIG. 8 is a partial enlarged plan view of one embodiment of the present invention, illustrating an alternate use of a weave pattern to facilitate electrical connection through mechanical contact.

Referring now to FIG. 8, there is shown a partial enlarged plan view of an embodiment of the present invention, illustrating an alternate use of a weave pattern for making electrical connections. As illustrated, the first connection bus strand 111 has two yarns 111*a* and 111*b* which are twisted over each other between yarns in the second yarn set 200. The conductive resistance yarn 220 is trapped between the first connection bus yarn strands 11*a/b*. The use of leno weave yarns can also be done in association with the second supply bus strand 112 to facilitate connections therewith.

Figure 9:
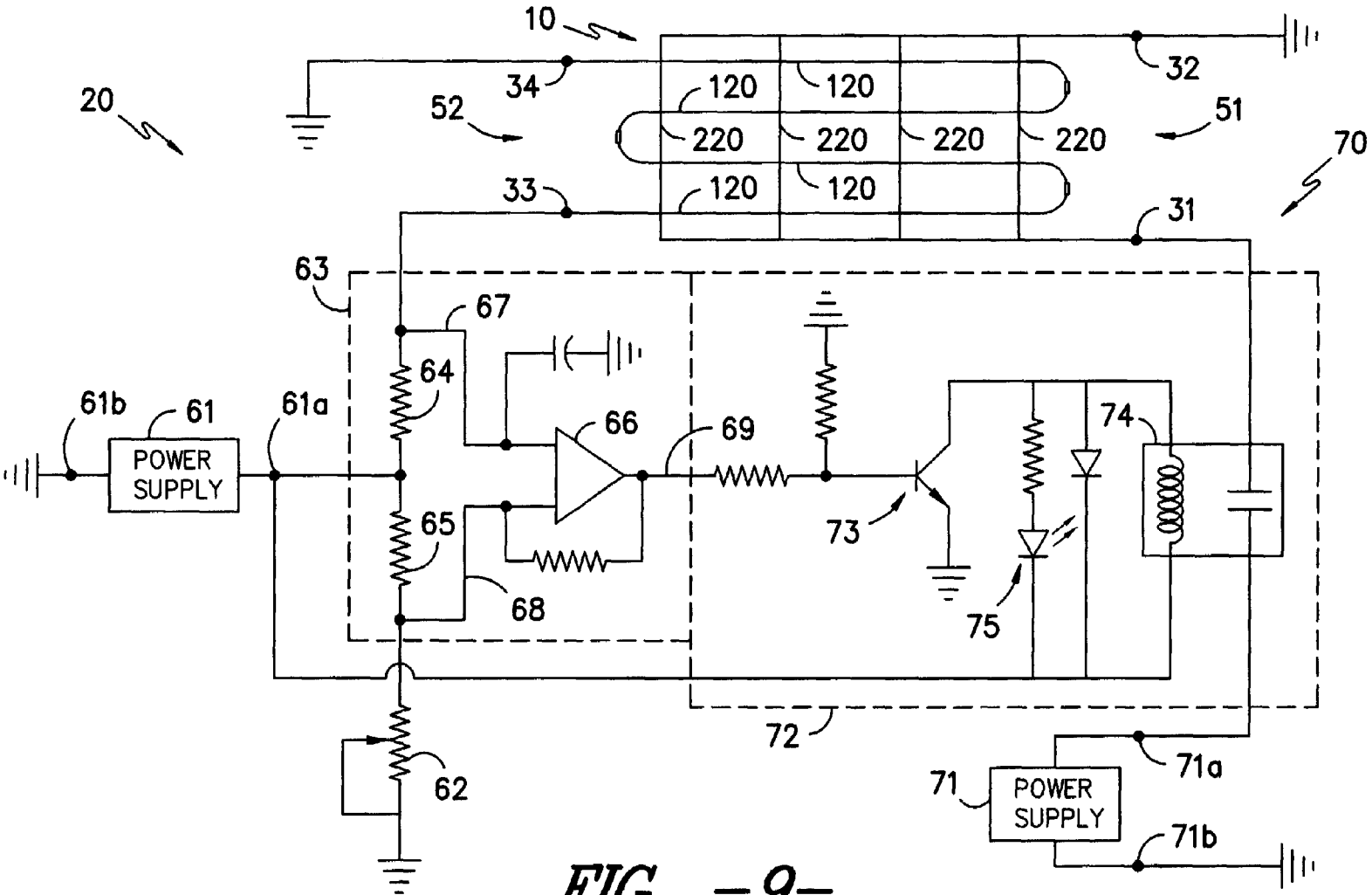
FIG. 9 is a block diagram of the present invention, illustrating the flexible heater with the control and heating circuits.

Referring now to FIG. 9 there is shown an embodiment of a regulated flexible heater 20 utilizing the conductive resistance pathway 51 and the TDVR pathway 52 from FIGS. 1–8. The regulated flexible heater 20 also includes a comparator circuit element 63, a set point resistor 62, a control circuit element 72, primary power connections 71*a* and 71*b* for receiving electrical power from a primary power source 71, and secondary power connections 61*a* and 61*b* for receiving secondary power from a secondary power source 61. The conductive resistance pathway 51 is electrically connected between the control 72 and ground. The TDVR pathway 52 is electrically connected between the comparator circuit element 63 and ground. The set point resistor 64 is electrically connected between the comparator circuit element 63 and ground. The primary power source connections 71*a/b* electrically connect the primary power source 71 between ground and the control 72. The secondary power source connections 61*a/b* electrically connect the secondary power source 61 between ground and both the comparator circuit element 63 and the control 72. As used herein, the term power supply can refer to a battery or batteries, an available power source such as provided by electrical power connections of home or other utility supplied location, or components that convert power to a desired useable form from other power sources, such as transformers, solar cells, or the like. Power sources can supply alternating current or direct current. As used herein, the term power source connections can refer to permanent connections to power supply components, or connections that can be connected or disconnected.

Still referring to FIG. 9, the comparator circuit element 63 generally includes a sensor resistor 64, a set point divider resistor 65, and a voltage comparator 66. The sensor resistor 64 is electrically connected in series with the TDVR pathway 52 and the secondary power supply 61, via the secondary power supply connections 61*a*. The sensor resistor 64 is preferably about the same resistance as the TDVR pathway 52 at the estimated desired temperature of the TDVR pathway 52. The sensor resistor 64 forms a voltage divider with the TDVR pathway 52. An electrical connection is made between the TDVR pathway 52 and the sensor resistor 64 to provide a sensor signal 67 to the comparator 66. The set point divider resistor 65 is electrically connected in series with the set point resistor 62 and the secondary power supply 61, via the secondary power supply connections 61*a*. As illustrated, the set point resistor 62 is a variable resistor, but it is contemplated that it may also be a fixed value resistor. The set point divider resistor 65 is preferably about the same resistance as the set point resistor 62 at the full resistance value of the set point resistor 62. The set point divider resistor 65 forms a voltage divider with the set point resistor 62. An electrical connection is made between the set point resistor 62 and the set point divider resistor 65 to provide a set point signal 68 to the comparator 66. The comparator 66 is preferably a voltage comparator, such as an op amp. In an embodiment where the comparator 66 is an op amp, the comparator circuit element 63 can also include an feedback resistor and/or a low pass filter. The comparator 66 has a comparator output 69 which is based upon the sensor signal 67 and the set point signal 68.

Referring still to FIG. 9, the comparator output 69 has a connect condition and a disconnect condition. In an embodiment where the TDVR pathway 52 has a PTC material, the connect condition indicates when the resistance of the temperature dependent variable resistance pathway 52 is below a control value having a predetermined relationship to the resistance of the set point resistor 62 and the disconnect condition indicates when the resistance of the temperature dependent variable resistance pathway 52 is above the predetermined control value. In an embodiment where the TDVR pathway 52 has a NTC material, the connect condition indicates when the resistance of the temperature dependent variable resistance pathway 52 is above a control value having a predetermined relationship to the resistance of the set point resistor 62 and the disconnect condition indicates when the resistance of the temperature dependent variable resistance pathway 52 is below the predetermined control value.

Still referring to FIG. 9, the regulated flexible heater 20 has a heating circuit element 70 which generally comprises the conductive resistance pathway 51, the control circuit element 72, the primary power connections 71*a/b* for connection of the primary power source 71. The conductive resistance power connection 31 and the conductive resistance ground connection 32 of the conductive resistance pathway 51 are electrically connected to the primary power connections 71*a/b* via the control circuit element 72. As illustrated, the control circuit element 72 includes a output control transistor 73, a relay 74, and an indicator light 75, such as a light emitting diode. The output control transistor 73 receives the comparator output 69 from the comparator circuit element 63. As illustrated, the coil of the relay 74 receives current from the secondary power supply 61, the flow of which is controlled by the output control 73 in response to the comparator output 69. Although the present invention is illustrated with the relay 74 using power from the secondary power supply 61, any current source could be used. The indicator light 75 is connected across the relay 74 and provides a positive light when the relay 74 closes. When the comparator output 69 is in a connect condition, the relay 74 of the control circuit element 72 closes to connect the primary power source 71, via the primary power source connection 71*a*, with the conductive resistance pathway 51. When the comparator output 69 is in a disconnect condition, the relay 74 of the control 72 opens to disconnect the conductive resistance pathway 51 from the primary power source connection 71*a* and the primary power source 71.

Referring still to FIG. 9, in an example where the TDVR pathway uses a PTC material and a relay 74 which closes when activated, when the resistance of the TDVR pathway 52 decreases such that the voltage of the sensor signal 67 to comparator 66 is lower than the voltage of the set point signal 68 to the comparator 66, the comparator output 69 to the control circuit element 72 is a voltage which facilitates the flow of current through the relay 74 which electrically connects the conductive resistance pathway 51 with the primary power source 71 via the primary power source connections 71*a/b*. The conductive resistance pathway 51 generates heat in the flexible heater 10 when connected with the primary power source 71. As the heating circuit element 70 increases the temperature of the flexible heater 10, the resistance of the TDVR pathway 52 increases. When the resistance of the TDVR pathway 52 increases such that the voltage of the sensor signal 67 to the comparator 66 is greater than the voltage of the set point signal 68 to the comparator 66, the comparator output 69 of the control circuit element 72 is no longer a voltage which facilitates flow of current through the relay 74, which electrically disconnects the conductive resistance pathway 51 from the primary power source 71 via the primary power source connections 71*a/b*. Disconnection of the conductive resistance pathway 51 from the primary power source 71 stops the generation of heat within the flexible heater 10 by the conductive resistance pathway 51, and allows the temperature of the flexible heater 10 to decrease. Contemplated within the present invention is the use of other components to accomplish the same results that may operate in other fashions, such as a TDVR pathway that uses NTC material or a relay that opens when activated.

What is claimed is:

1. A regulated flexible heater for using electrical power from a primary power supply to provide regulated heat, the regulated flexible heater comprising:

a temperature dependent variable resistance pathway including at least one flexible temperature dependent variable resistance strand of material having a positive coefficient of temperature to resistance;

a set point resistor;

a comparator circuit element, wherein the comparator circuit element monitors the resistance of the flexible temperature dependent variable resistance pathway and the set point resistor, and wherein the comparator circuit element has a comparator output with a connect condition indicating when resistance of the temperature dependent variable resistance pathway is below a control value having a predetermined relationship to the set point resistance and a disconnect condition indicating when the resistance of the temperature dependent variable resistance pathway is above the predetermined control value;

a heating circuit element including:

heating connections for receiving the electrical power from the primary power supply;

a conductive resistance pathway including at least one flexible conductive resistance strand of material;

a control circuit element receiving the comparator output, wherein the control circuit element opens the heating circuit element when the comparator output is in the disconnect condition;

wherein the flexible conductive resistance strand of material and flexible temperature dependent variable resistance strand of material are combined into a flexible planar body; and, wherein the flexible temperature dependent variable resistance strand of material and flexible conductive resistance strand of material run separate and distinct routes through the flexible body.

2. The regulated flexible heater according to claim 1, wherein the control circuit element closes the heating circuit element when the comparator output condition is in the connect condition.

3. The regulated flexible heater according to claim 1, further including secondary power connections for receiving a secondary power, wherein the comparator circuit element further comprises:

a sensor resistor connected in series with the temperature dependent variable resistance pathway and the secondary power connections;

a set point divider resistor connected in series with the set point resistor and the secondary power connections; and, a voltage comparator receiving a sensor voltage from between the sensor resistor and the temperature dependent variable resistance pathway, receiving a set point voltage from between the set point resistor and the set point divider resistor, wherein the voltage comparator provides the comparator output based upon the sensor voltage and the set point voltage.

4. The regulated flexible heater according to claim 3, wherein the voltage comparator comprises an op amp.

5. The regulated flexible heater according to claim 1, wherein the control circuit element includes a relay which opens the heating electrical circuit when the comparator output is in the disconnect condition.

6. The regulated flexible heater according to claim 5, wherein the control circuit element includes a transistor connected to receive the comparator output, and wherein the transistor amplifies the comparator output for activation and deactivation of the relay.

7. The regulated flexible heater according to claim 1, wherein the temperature dependent variable resistance pathway comprises a plurality of flexible temperature dependent variable resistance strands of material having a positive coefficient of temperature to resistance.

8. The regulated flexible heater according to claim 1, wherein the conductive resistance pathway comprises a plurality of flexible conductive resistance strands of material.

9. The regulated flexible heater according to claim 1, wherein the flexible body further includes a plurality of flexible nonconductive strands of material interlaced together.

10. The regulated flexible heater according to claim 9, wherein the flexible temperature dependent variable resistance strands of material, the flexible conductive strands of material, and the flexible nonconductive strands of material, are yarns.

11. A regulated flexible heater for using electrical power from a primary power supply to provide regulated heat, the regulated flexible heater comprising:

a temperature dependent variable resistance pathway including at least one flexible temperature dependent variable resistance strand of material having a negative coefficient of temperature to resistance;

a set point resistor;

a comparator circuit element, wherein the comparator circuit element monitors the resistance of the flexible temperature dependent variable resistance pathway and the set point resistor, and wherein the comparator circuit element has a comparator output with a connect condition indicating when resistance of the temperature dependent variable resistance pathway is above a control value having a predetermined relationship to the set point resistance and a disconnect condition indicating when the resistance of the temperature dependent variable resistance pathway is below the predetermined control value;

a heating circuit element including:

heating connections for receiving the electrical power from the primary power supply;

a conductive resistance pathway including at least one flexible conductive resistance strand of material;

a control circuit element receiving the comparator output, wherein the control circuit element opens the heating circuit element when the comparator output is in the disconnect condition;

wherein the flexible conductive resistance strand of material and flexible temperature dependent variable resistance strand of material are combined into a flexible planar body; and, wherein the flexible temperature dependent variable resistance strand of material and flexible conductive resistance strand of material run separate and distinct routes through the flexible body.

12. The regulated flexible heater according to claim 11, wherein the control circuit element closes the heating circuit element when the comparator output condition is in the connect condition.

13. The regulated flexible heater according to claim 11, further including secondary power connections for receiving a secondary power, wherein the comparator circuit element further comprises:

a sensor resistor connected in series with the temperature dependent variable resistance pathway and the secondary power connections;

a set point divider resistor connected in series with the set point resistor and the secondary power connections; and, a voltage comparator receiving a sensor voltage from between the sensor resistor and the temperature dependent variable resistance pathway, receiving a set point voltage from between the set point resistor and the set point divider resistor, wherein the voltage comparator provides the comparator output based upon the sensor voltage and the set point voltage.

14. The regulated flexible heater according to claim 13, wherein the voltage comparator comprises an op amp.

15. The regulated flexible heater according to claim 11, wherein the control circuit element includes a relay which opens the heating electrical circuit when the comparator output is in the disconnect condition.

16. The regulated flexible heater according to claim 15, wherein the control circuit element includes a transistor connected to receive the comparator output, and wherein the transistor amplifies the comparator output for activation and deactivation of the relay.

17. The regulated flexible heater according to claim 11, wherein the temperature dependent variable resistance pathway comprises a plurality of flexible temperature dependent variable resistance strands of material having a negative coefficient of temperature to resistance.

18. The regulated flexible heater according to claim 11, wherein the conductive resistance pathway comprises a plurality of flexible conductive resistance strands of material.

19. The regulated flexible heater according to claim 11, wherein the flexible body further includes a plurality of flexible nonconductive strands of material interlaced together.

20. The regulated flexible heater according to claim 19, wherein the flexible temperature dependent variable resistance strands of material, the flexible conductive strands of material, and the flexible nonconductive strands of material, are yarns.

21. A regulated flexible heater for using electrical power from a primary power supply to provide regulated heat, the regulated flexible heater comprising:

a temperature dependent variable resistance pathway including at least one flexible temperature dependent variable resistance strand of material having a positive coefficient of temperature to resistance;

a variable set point resistor;

a comparator circuit element, wherein the comparator circuit element monitors the resistance of the flexible temperature dependent variable resistance pathway and the set point resistor, and wherein the comparator circuit element has a comparator output with a connect condition indicating when resistance of the temperature dependent variable resistance pathway is below a control value having a predetermined relationship to the set point resistance and a disconnect condition indicating when the resistance of the temperature dependent variable resistance pathway is above the predetermined control value;

a heating circuit element including:

heating connections for receiving the electrical power from the primary power supply;

a conductive resistance pathway including at least one flexible conductive resistance strand of material;

a control circuit element receiving the comparator output, wherein the control circuit element opens the heating circuit element when the comparator output is in the disconnect condition; and, wherein the flexible conductive resistance strand of material and flexible temperature dependent variable resistance strand of material are combined into a flexible planar body.

22. The regulated flexible heater according to claim 21, wherein the control circuit element closes the heating circuit element when the comparator output condition is in the connect condition.

23. The regulated flexible heater according to claim 21, further including secondary power connections for receiving a secondary power, wherein the comparator circuit element further comprises:

a sensor resistor connected in series with the temperature dependent variable resistance pathway and the secondary power connections;

a set point divider resistor connected in series with the set point resistor and the secondary power connections; and, a voltage comparator receiving a sensor voltage from between the sensor resistor and the temperature dependent variable resistance pathway, receiving a set point voltage from between the set point resistor and the set point divider resistor, wherein the voltage comparator provides the comparator output based upon the sensor voltage and the set point voltage.

24. The regulated flexible heater according to claim 23, wherein the voltage comparator comprises an op amp.

25. The regulated flexible heater according to claim 21, wherein the control circuit element includes a relay which opens the heating electrical circuit when the comparator output is in the disconnect condition.

26. The regulated flexible heater according to claim 25, wherein the control circuit element includes a transistor connected to receive the comparator output, and wherein the transistor amplifies the comparator output for activation and deactivation of the relay.

27. The regulated flexible heater according to claim 21, wherein the temperature dependent variable resistance pathway comprises a plurality of flexible temperature dependent variable resistance strands of material having a positive coefficient of temperature to resistance.

28. The regulated flexible heater according to claim 21, wherein the conductive resistance pathway comprises a plurality of flexible conductive resistance strands of material.

29. The regulated flexible heater according to claim 21, wherein the flexible body further includes a plurality of flexible nonconductive strands of material interlaced together.

30. The regulated flexible heater according to claim 29, wherein the flexible temperature dependent variable resistance strands of material, the flexible conductive strands of material, and the flexible nonconductive strands of material, are yarns.

31. A regulated flexible heater for using electrical power from a primary power supply to provide regulated heat, the regulated flexible heater comprising:

a temperature dependent variable resistance pathway including at least one flexible temperature dependent variable resistance strand of material having a negative coefficient of temperature to resistance;

a variable set point resistor;

a comparator circuit element, wherein the comparator circuit element monitors the resistance of the flexible temperature dependent variable resistance pathway and the set point resistor, and wherein the comparator circuit element has a comparator output with a connect condition indicating when resistance of the temperature dependent variable resistance pathway is above a control value having a predetermined relationship to the set point resistance and a disconnect condition indicating when the resistance of the temperature dependent variable resistance pathway is below the predetermined control value;

a heating circuit element including:

heating connections for receiving the electrical power from the primary power supply;

a conductive resistance pathway including at least one flexible conductive resistance strand of material;

a control circuit element receiving the comparator output, wherein the control circuit element opens the heating circuit element when the comparator output is in the disconnect condition; and, wherein the flexible conductive resistance strand of material and flexible temperature dependent variable resistance strand of material are combined into a flexible planar body.

32. The regulated flexible heater according to claim 31, wherein the control circuit element closes the heating circuit element when the comparator output condition is in the connect condition.

33. The regulated flexible heater according to claim 31, further including secondary power connections for receiving a secondary power, wherein the comparator circuit element further comprises:

a sensor resistor connected in series with the temperature dependent variable resistance pathway and the secondary power connections;

a set point divider resistor connected in series with the set point resistor and the secondary power connections; and, a voltage comparator receiving a sensor voltage from between the sensor resistor and the temperature dependent variable resistance pathway, receiving a set point voltage from between the set point resistor and the set point divider resistor, wherein the voltage comparator provides the comparator output based upon the sensor voltage and the set point voltage.

34. The regulated flexible heater according to claim 33, wherein the voltage comparator comprises an op amp.

35. The regulated flexible heater according to claim 31, wherein the control circuit element includes a relay which opens the heating electrical circuit when the comparator output is in the disconnect condition.

36. The regulated flexible heater according to claim 35, wherein the control circuit element includes a transistor connected to receive the comparator output, and wherein the transistor amplifies the comparator output for activation and deactivation of the relay.

37. The regulated flexible heater according to claim 31, wherein the temperature dependent variable resistance pathway comprises a plurality of flexible temperature dependent variable resistance strands of material having a negative coefficient of temperature to resistance.

38. The regulated flexible heater according to claim 31, wherein the conductive resistance pathway comprises a plurality of flexible conductive resistance strands of material.

39. The regulated flexible heater according to claim 31, wherein the flexible body further includes a plurality of flexible nonconductive strands of material interlaced together.

40. The regulated flexible heater according to claim 39, wherein the flexible temperature dependent variable resistance strands of material, the flexible conductive strands of material, and the flexible nonconductive strands of material, are yarns.

* * * * *